US005630728A

United States Patent [19]

Watters, Jr.

[11] Patent Number: 5,630,728

[45] Date of Patent: May 20, 1997

[54] PLUG HOLDER

[76] Inventor: Henry W. Watters, Jr., Rte. 3, Box 8700, Bartlesville, Okla. 74003

[21] Appl. No.: 548,327

[22] Filed: Nov. 1, 1995

[51] Int. Cl.[6] ..... H01R 13/66

[52] U.S. Cl. ..... 439/528

[58] Field of Search ..... 439/528, 929, 439/345, 350, 385

[56] References Cited

U.S. PATENT DOCUMENTS

| | | | |
|---|---|---|---|
| 3,176,257 | 3/1965 | Introvigne | 339/38 |
| 4,142,226 | 2/1979 | Mears | 361/380 |
| 4,481,458 | 11/1984 | Lane | 439/929 |
| 4,738,641 | 4/1988 | Eversole, Jr. | 439/528 |
| 4,772,220 | 9/1988 | Hallier, Jr. | 439/528 |
| 4,940,427 | 7/1990 | Pearson et al. | 439/501 |
| 5,129,828 | 7/1992 | Bass | 439/35 |

*Primary Examiner*—Neil Abrams
*Assistant Examiner*—Eugene G. Byrd
*Attorney, Agent, or Firm*—Molly D. McKay, P.C.

[57] ABSTRACT

A plug holder securable to a vehicle for removably receiving the vehicle's electrical pigtail plug when the plug is not in use. The plug holder is provided with a front, a back and two side walls which join together with a floor in order to define a top opening open space in the plug holder into which the plug removably inserts. The front wall is provided with graduated vertical ribs against which the plug wedges as it is inserted into the plug holder as a means of retaining it therein. The floor of the plug holder is provided with moisture releasing openings which allow moisture to escape from the open space.

10 Claims, 2 Drawing Sheets

PLUG HOLDER

BACKGROUND OF THE INVENTION

1. Field of the Invention

The present invention relates to a holder for an electrical plug such as those commonly used to electrically connect a towing vehicle to the electrical system of a vehicle being towed, such as a trailer.

2. Description of the Related Art

Vehicles, such as trailers and boats, which are normally towed behind another vehicle, such as a pickup truck or automobile, generally are provided with electrical lights which receive power via electrical connection with the electrical system of the vehicle behind which they are being towed. This electrical connection normally includes a pair of mating connectors located near where the vehicles connect together, with one of the mating connectors attached to electrical wires attached to the towing vehicle and the other one of the mating connectors attached to electrical wires attached to the towed vehicle. When the towed vehicle is disconnected from the towing vehicle, the connectors are disengaged from each other and because there is no place to secure the connectors, they often are allowed to dangle from the electrical wire connecting them to the vehicle, resulting in the connector becoming dirty and damaged and the connecting wires becoming damaged.

A variety of retainers have been proposed for securing disengaged connectors to their associated vehicle, but these prior retainers generally are difficult and time consuming to use, do not prevent the connector from becoming dirty and do not protect the delicate prongs of the connectors from damage.

The present invention addresses these problems. One of the objects of the present invention is to provide an economical means for securing an electrical connector to its associated vehicle when the connector is not in use.

Another one of the objects of the present invention is to provide a device for retaining electrical plugs which is quick and easy to use.

Still another object of the invention is to provide a holder which protects the connector from becoming dirty, even when the vehicle travels in muddy environments.

A further object of the invention is to provide a holder which will hold a connector securely, but will still allow moisture to escape from around the connector.

A still further object of the invention to provide a holder which will protect the connector from physical damage by providing a cushioning envelope surrounding the delicate prongs of the connector.

SUMMARY OF THE INVENTION

The invention is a plug holder which secures by means of a fastener, such as a bolt, to a vehicle. The fastener extends through a hole provided in a back wall of the plug holder, and in the case where a bolt serves as the fastener, the fastener extends through an opening in the vehicle and is secured therein by a nut.

The plug holder is provided with two spaced apart, parallel side walls and a front wall which is perpendicular to the side walls and parallel with and spaced apart from the back wall, thereby forming an open space between the four walls. The front wall has a height somewhat less than a height of the back wall and the upper edges of the side walls extend upward at an angle from the front wall to the back wall in order to provide support for the back wall. An inwardly facing surface of the front wall is provided with a plurality of vertically oriented ribs which are graduated in depth so that the ribs increase in depth and more closely approach the back wall as the ribs approach a floor provided at a bottom end of the plug holder. The floor is provided with a plurality of moisture releasing openings. An electrical plug which attaches by means of electrical wires to the vehicle can be removably inserted into the open space of the plug holder via an open end of the plug holder.

DETAILED DESCRIPTION OF THE PREFERRED EMBODIMENT

Figure 1:
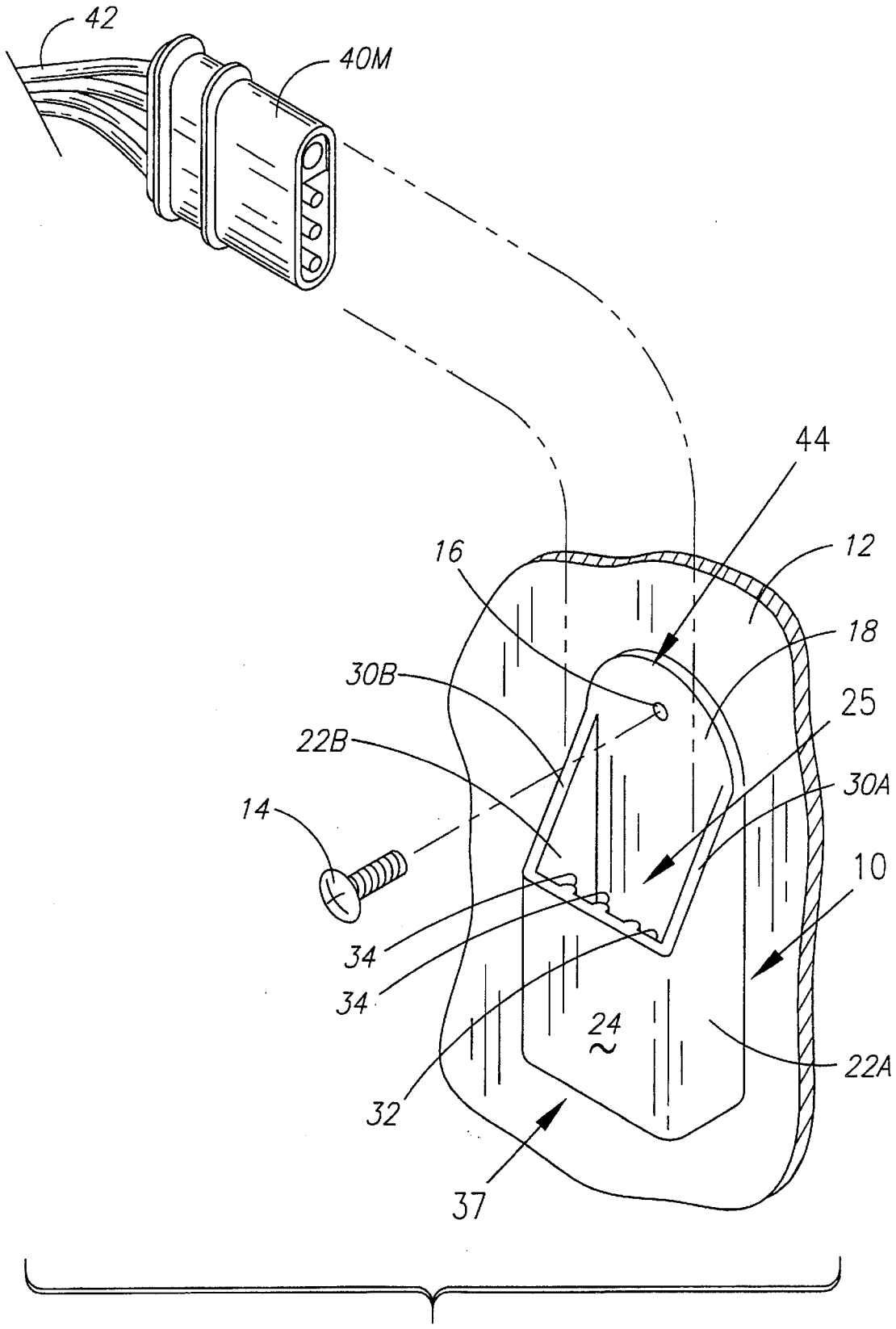
FIG. 1 is a perspective view of a plug holder constructed in accordance with a preferred embodiment of the present invention, illustrating by broken lines insertion of a male plug into the plug holder.
Figure 2:
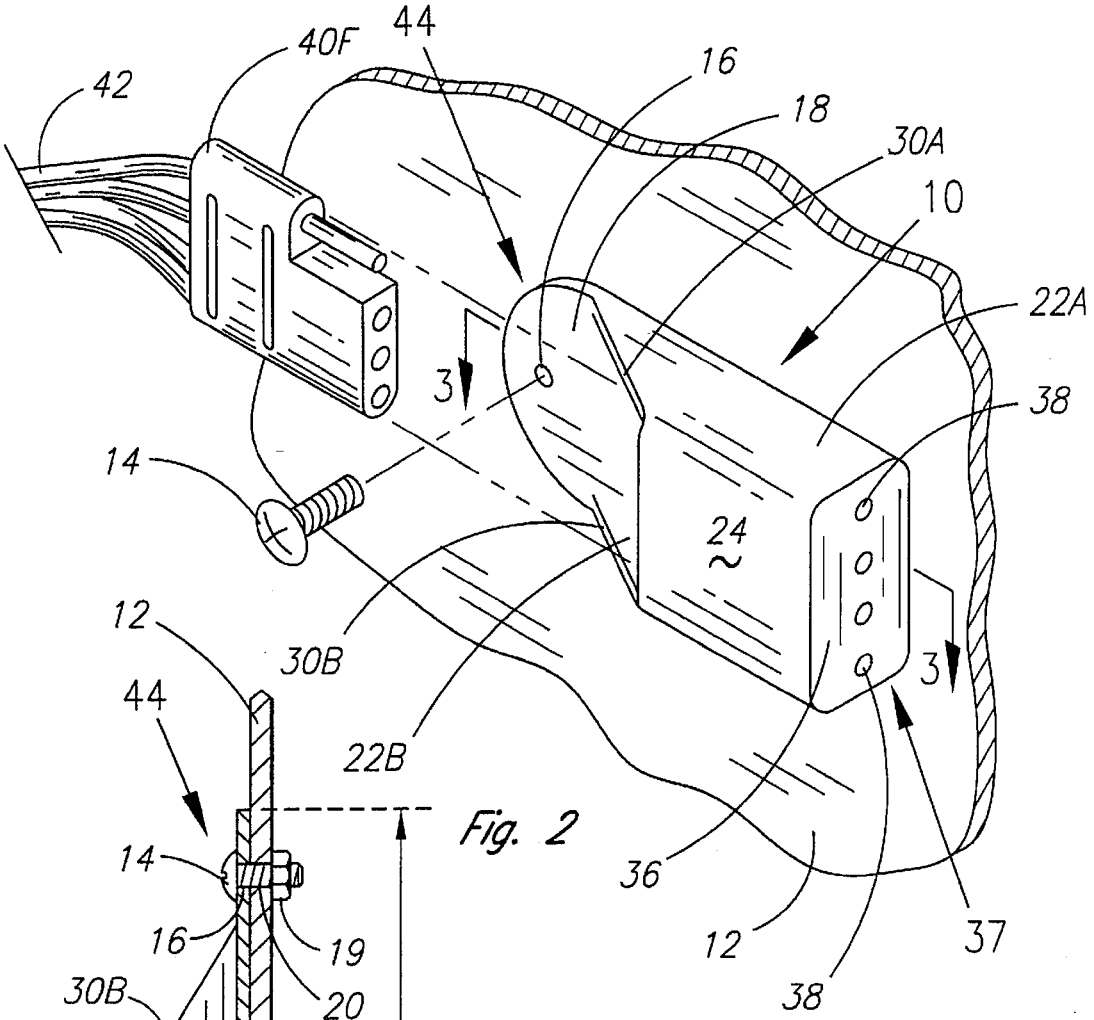
FIG. 2 is a perspective view of the plug holder of FIG. 1 oriented at a 90° angle from the orientation illustrated in FIG. 1, illustrating by broken lines insertion of a female plug into the plug holder.
Figure 3:
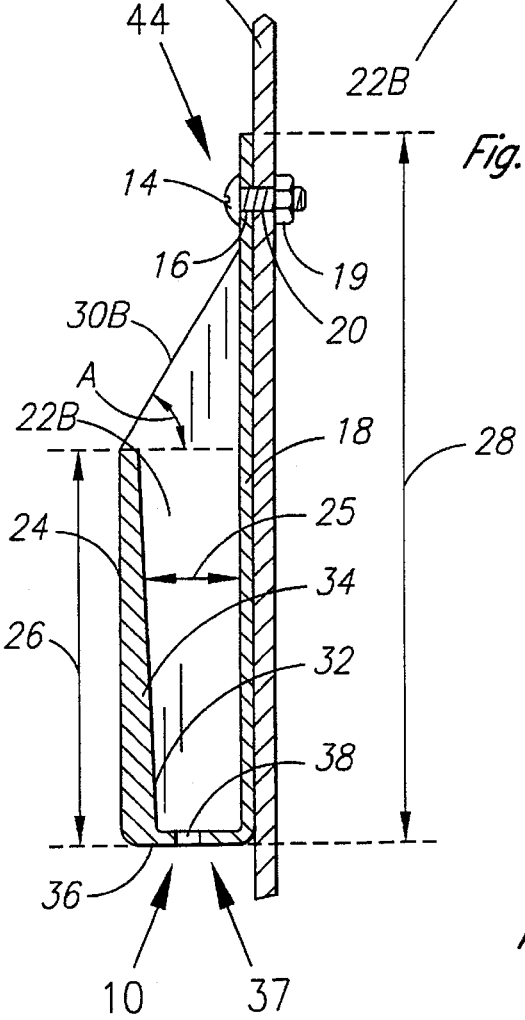
FIG. 3 is a cross-sectional view taken along line 3—3 of FIG. 2, showing the plug holder bolted onto a vehicle.

Referring now to the drawings, and initially to FIGS. 1 and 2, there is illustrated a plug holder 10 constructed in accordance with a preferred embodiment of the present invention. The plug holder 10 secures to a vehicle 12, for example a vehicle for towing such as a truck, or automobile, or a towed vehicle such as a trailer or a boat. The plug holder 10 secures to the vehicle 12 by means of a fastener 14, such as a bolt, which extends through a hole 16 provided in a back wall 18 of the plug holder 10. As illustrated in FIG. 3, if a bolt is employed as the fastener 14, it also extends through an opening 20 provided in the vehicle 12 and is secured therein by means of a nut 19 which tightens onto the fastener 14.

The plug holder 10 has two side walls 22A and 22B which secure a front wall 24 to the back wall 18, such that the side walls 22A and 22B are spaced apart and are approximately parallel with each other, the front and back walls 24 and 18 are spaced apart and are approximately parallel with each other, the side walls 22A and 22B are approximately perpendicular to the front and back walls 24 and 18, and an open space 25 is formed within the walls 18, 22A, 22B and 24.

As illustrated in FIG. 3, the front wall 24 has a front wall height 26 which is preferably less than a back wall height 28 of the back wall 18. Each of the side walls 22A and 22B is provided with an upper edge, 30A and 30B respectively, which extends upward at an angle "A" from the front wall 24 to the back wall 18 in order to provide additional support for the back wall 18 of the plug holder 10.

An inwardly facing surface 32 of the front wall 24 is provided with at least one, but preferably a plurality, of ribs 34 which extend outward from the surface 32 into the open space 25 and extend toward the back wall 18. The ribs 34 are each preferably vertically oriented and tapered in a graduated fashion from top to bottom of the front wall 24 so that the ribs 34 more closely approach the back wall 18 as they approach a floor 36 provided in the plug holder 10. The floor 36 is provided on a bottom end 37 of the plug holder 10 and secures to the walls 18, 22A, 22B and 24 at their lowest extremities, thereby forming an upwardly opening envelope.

As illustrated in FIGS. 2 and 3, the floor 36 is provided with at least one, and preferably a plurality, of moisture releasing openings 38 which extend through the floor 36, providing communication between the open space 25 located within the plug holder 10 and the external environment.

Normally, a pair of plug holders 10 are employed, with one of the pair being secured to a towing vehicle and the other one of the pair being secured to a towed vehicle. Each plug holder is designed to receive either a male electrical plug 40M, as illustrated in FIG. 1, or its mating female electrical plug 40F, as illustrated in FIG. 2, within the open space 25 of the plug holder 10 when the plugs 40M and 40F are disengaged from each other. These plugs 40M and 40F are commonly referred to as "pig tails" and tend to become dirty and damaged if allowed to dangle unsecured from the vehicle 12 to which they are attached by means of electrical wires 42. The plug, either 40M or 40F, inserts into the open space 25 via an upwardly oriented open end 44 of the plug holder 10 and wedges between the ribs 34 and the back wall 18. Because of the increasing depth of the ribs 34 as the ribs 34 approach the floor 36, the plug, either 40M or 40F, becomes more firmly wedged within the open space 25 as it is pushed further into the open space 25 of the plug holder 10. The plug holder 10 is preferably constructed of a flexible, resilient material, such as plastic, which can flex slightly as the plug, either 40M or 40F, is inserted within the open space 25, thereby causing the plug holder 10 to grip the plug, either 40M or 40F, even tighter. Construction of the plug holder 10 from flexible material also aids in withdrawing the plug, either 40M or 40F, from the plug holder 10. The plug holder 10 flexes outward when squeezed on its opposing side walls 22A and 22B, thereby causing the front wall 24 and its attached ribs 34 to flex outward away from the plug, 40M or 40F, thus releasing the plug 40M or 40F from its wedged position between the ribs 34 and the back wall 18 and allowing it to be easily pulled out of the plug holder 10.

As illustrated in FIG. 1, the plug holder 10 can be secured to a vehicle 12 in an upright orientation, or as illustrated in FIG. 2, the plug holder 10 can be secured to a vehicle 12 in a horizontal orientation. Although these two orientations of securing the plug holder 10 to the vehicle 12 are illustrated, the invention is not so limited and may be secured to the vehicle 12 in a variety of orientations. Once the plug 40M or 40F is secured within the plug holder 10 by inserting the plug 40M or 40F into the open space 25 until it wedges therein, the plug 40M or 40F is protected from dirt and damage. However, moisture which can damage the plug 40M or 40F may be on the plug 40M or 40F when it is inserted into the plug holder 10 or moisture may enter the plug holder 10 later. Moisture releasing openings 38 are provided in the floor 36 of the plug holder 10 in order to allow moisture to escape from the open space 25, thereby preventing the plug 40M or 40F from being damaged by continuous exposure to moisture.

Although the invention has been described and illustrated for use with a particular shape of plug 40M or 4OF, other shapes and sizes of plugs 40M or 40F may be accommodated by altering the dimensions of the plug holder 10 without departing from the teachings of the present invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A plug holder for removably receiving an automotive electrical plug comprising:

a back wall provided with means for securing said back wall to a vehicle, two spaced apart side walls each secured approximately perpendicularly to said back wall, a front wall secured approximately perpendicularly to each said side wall, said front wall spaced apart from said back wall and approximately parallel therewith, a floor securing approximately perpendicularly to said front, back and side walls, means for securing an electrical plug being provided on one wall, at least one rib being provided on an inwardly facing surface of said front wall of said plug holder, and each at least one rib being provided vertically on said front wall.

2. A plug holder according to claim 1 wherein each at least one rib is graduated in depth so that each at least one rib increases in depth and more closely approaches said back wall as the at least one rib approaches said floor.

3. A plug holder according to claim 2 wherein the plug holder is comprised of a flexible, resilient material.

4. A plug holder according to claim 3 wherein the flexible, resilient material is plastic.

5. A plug holder according to claim 2 further comprising:

said floor provided with at least one moisture releasing opening extending therethrough in order to provide a conduit for moisture out of an open space of the plug holder.

6. A plug holder according to claim 5 wherein said front wall has a front wall height which is less than a back wall height of said back wall, and said side walls extend on their upper edges upward at an angle from said front wall to said back wall in order to provide support for said back wall.

7. A plug holder according to claim 6 wherein the means for securing said back wall to a vehicle is a fastener which extends through a hole provided in said back wall and secures to said vehicle.

8. A plug holder for removably receiving an electrical plug comprising:

an envelope provided with an open end, said open end communicating with an open space provided within said envelope, at least one rib provided on an inwardly facing front wall of said envelope as a means for removably securing an electrical plug within said open space, each at least one rib being vertically attached to said front wall and extending the full length of said front wall, each at least one rib increasing in depth as it approaches a bottom of said envelope, and means for securing said envelope to a vehicle.

9. A plug holder according to claim 8 further comprising:

said envelope provided with at least one moisture releasing opening communicating between said open space and an external environment in order to permit moisture to escape from said open space.

10. A plug holder according to claim 8 wherein the means for securing said envelope to a vehicle comprises a fastener which extends through a hole provided in the envelope and secures to said vehicle.

* * * * *